United States Patent [19]

Walsh

[11] Patent Number: 4,728,848

[45] Date of Patent: Mar. 1, 1988

[54] ENERGY-EFFICIENT INCANDESCENT REFLECTOR LAMP

[75] Inventor: Peter J. Walsh, Stirling, N.J.

[73] Assignee: Duro-Test Corporation, North Bergen, N.J.

[21] Appl. No.: 319,223

[22] Filed: Nov. 9, 1981

[51] Int. Cl.[4] ..... H01K 1/28

[52] U.S. Cl. ..... 313/113; 313/634

[58] Field of Search ..... 313/112, 113, 634

[56] References Cited

U.S. PATENT DOCUMENTS

| | | | |
|---|---|---|---|
| 2,818,521 | 12/1957 | Myers | 313/113 |
| 3,010,045 | 11/1961 | Plagge et al. | 313/113 |
| 4,039,878 | 8/1977 | Eijkelenboom et al. | 313/112 X |
| 4,160,929 | 7/1979 | Thorington et al. | 313/112 |
| 4,227,113 | 10/1980 | Walsh | 313/112 |

*Primary Examiner*—Daivd K. Moore
*Assistant Examiner*—Sandra L. O'Shea
*Attorney, Agent, or Firm*—Darby & Darby

[57] ABSTRACT

An incandescent lamp of the reflector type has an exit window on which a filter coating is located. The filter coating reflects infrared radiation and transmits visible radiation. The clamp also has a reflector which is opposed to the filter coating and which reflects both infrared and visible radiation. The filter coating and the reflector have surfaces which are parabolic, confocal, and orthogonal. The filament passes through the focus and is elongated along the focal axis of the lamp. Infrared radiation emitted by the filament from the focus is reflectd back to it after two reflections, of which one reflection will be off the filter coating and of which the other will be off the reflector. A large part of the light produced by the lamp is collimated.

21 Claims, 3 Drawing Figures

ENERGY-EFFICIENT INCANDESCENT REFLECTOR LAMP

This invention pertains to incandescent lamps of the type which produce a directed beam of light, such as spotlights and flood lights. Such lamps have an envelope and a reflector that forms the light produced by the incandescent filament into a desired pattern. The reflector, of e.g. silver of aluminum, reflects visible radiation and radiation in the infrared.

It is known to provide a lamp of this type with a filter coating placed on the light exit window of the lamp to permit visible radiation to leave the lamp while reflecting infrared radiation back towards the filament. For example, U.S. Pat. No. 4,039,878 discloses a reflector lamp in which the reflector has an elliptical surface and the filter coating on the exit window has a hyperbolic surface. In this patent the foci of the surfaces in question coincide, and the filament is coincident with the foci.

In the lamp there disclosed, the infrared radiation reflected by the filter coating is directed onto the filament, raising its temperature and increasing lamp efficiency. However, the visible radiation which leaves the lamp is not well collimated. As a result, this lamp cannot produce a highly directional beam of intense illumination.

It is therefore advantageous to provide a lamp of this type which would improve upon the prior art.

One object of the invention is to provide an incandescent lamp of the reflector type which is energy-efficient.

Another object is to provide an incandescent lamp of the reflector type which produces a well collimated beam.

In accordance with the present invention, this is achieved by providing a lamp with a reflector having a parabolic surface. An infrared reflecting and visible transmitting filter coating having a parabolic surface is mounted to the exit window. The parabolic surfaces are confocal and orthogonal. Furthermore, the filament coincides with the focus of the parabolic surfaces.

As a result, a substantial amount of the visible radiation emitted by the filament will be collimated parallel to the focal axis of the lamp and will be highly directed and intense. Furthermore, a substantial amount of the infrared radiation emitted from the filament will be reflected back to it from both surfaces.

BRIEF DESCRIPTION OF THE DRAWINGS

The drawings show presently preferred but merely illustrative embodiments of the invention, and, more particularly.

DETAILED DESCRIPTION OF PREFERRED EMBODIMENTS

Figure 1:
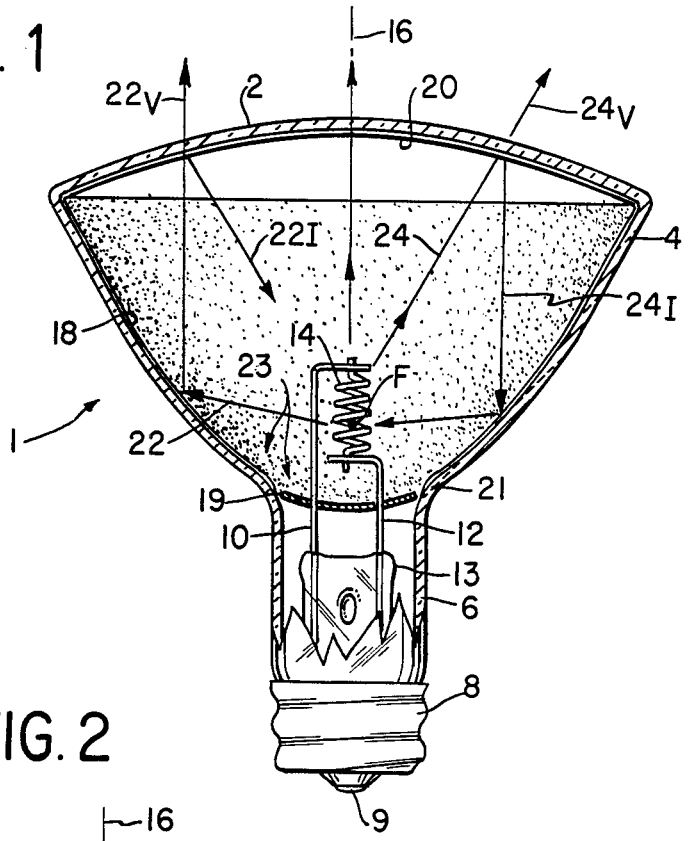
FIG. 1 shows a cross-sectional view of a lamp in accordance with the invention.

Although the invention is generally applicable to all incandescent reflector-type lamps, FIG. 1 illustrates the invention utilized in a lamp which has dimensions similar to those of a PAR 38 type reflector lamp now sold by Duro-Test Corporation, the assignee herein. The lamp has a hollow envelope generally indicated by reference numeral 1. Envelope 1 is formed of, e.g., lime glass or any other suitable material and has an exit window 2, a main body 4 and a neck 6. Envelope 1 may be made as a unit, or the exit window 2 may be made as a separate piece.

Exit window 2 is convex with its concave surface inside the lamp. Main body 4 is also convex and also has its concave surface inside the lamp.

Neck 6 is elongated and generally cylindrical and extends away from the center of main body 4. A conventional threaded terminal 8 and a button terminal 9 are attached to the end of neck 6. Leads 10 and 12 are connected to terminals 8 and 9 and pass into the lamp through a reentrant stem 13 within neck 6. The other ends of leads 10 and 12 are connected to the two ends of filament 14, which is located within the interior volume bounded by main body 4 and exit window 2. Although leads 10 and 12 are shown connected to conventional terminals 8 and 9, any other suitable means for connecting a voltage source (not shown) across filament 14 may also be used; the particular arrangement of leads, the shape of neck 6 shown in FIG. 1 and terminals 8 and 9 form no part of the invention.

The inner surface of main body 4 has a shape which is a portion of a parabola, and faces concave inwardly. This surface is not itself parabolic because, in this example, main body 4 and neck 6 are integral and there is thus a discontinuous gap at the bottom of main body 4. To complete the shape of the inner surface of main body 4 and to form a true parabola, a dish-shaped plate 19 is placed to fill this gap, i.e. is placed within the envelope at region 21, where main body 4 and neck 6 meet. The surface of plate 19 is parabolic.

A layer 18 of a material which reflects both visible radiation and infrared radiation is placed on the inner surface of main body 4. In this example, layer 18 is a layer of silver laid down by vapor deposition, chemical deposition, sputtering, or any other suitable method, but other materials (such as gold or highly polished aluminum) may be used instead. Plate 19 is also made of a material which will reflect visible and infrared radiation, and may be made of the same material as layer 18, although this is not necessary. For ease of assembly, plate 19 can be a part of neck 6, or can be mounted to stem 13 or leads 10 and 12, as shown in FIG. 1.

Since plate 19 conforms to the shape of layer 18, they together act as a reflector generally indicated by reference numeral 23. Reflector 23 has a parabolic surface and reflects both visible and infrared radiation. It is known from optics that such a reflector with a parabolic surface will have a focus on a focal axis. Here, the focus is located inside the lamp and is indicated by reference letter F and the focal axis is indicated by line 16.

Although the structure described above is preferred, it is not necessary that reflector 23 be composed of two separate parts, such as layer 18 and plate 19. They may alternatively be replaced by a unit having a parabolic inner surface and the characteristic of reflecting both visible and infrared radiation. Thus unit can be enclosed within the envelope, and in this alternate construction, the inner surface of main body 4 need not have any optically critical shape.

Exit window 2 also has a parabolic surface facing concave inwardly. In FIG. 1, exit window 2 is shown with a parabolic inner surface on which a filter coating 20 is placed. Filter coating 20 could alternatively be located on the outer surface of exit window 2, were the outer surface likewise parabolic and facing concave inwardly. The surface of filter coating 20 has a focus which is also located at focus F, so that the surfaces of filter coating 20 and reflector 23 are confocal. Additionally, the focal axis of the surface of filter coating 20 is coincident with focal axis 16 and the surfaces of filter coating 2 and reflector 23 face each other, making these surfaces orthogonal to the focal axis 16.

Filter coating 20 is of a type which reflects infrared radiation and transmits visible radiation. Filter coating 20 is preferably located inside the lamp to prevent damage arising from handling or contamination. Filter coating 20 can be alternatively located on the outer surface of exit window 2.

In a preferred embodiment, filter coating 20 is a three-layer coating in which the innermost and outermost layers (i.e., those layers which are closest to and furthest away from focus F respectively) are titanium dioxide, while the middle layer of coating 20 is a layer of silver. Other alternative materials suitable for use in the layers of filter coating 20 are described in U.S. Pat. No. 4,160,929. Another set of materials can be a discrete layer of dielectric material such as titanium dioxide which is sandwiched between two layers of a highly electrically conductive metal such as silver. The filter coating can also be one in which all the layers are semiconductor-type materials. The layers of filter coating 20 can be laid down by radio frequency sputtering, vapor-deposition or by any other suitable technique. Since exit window 2 in this example is not highly curved, the layers of filter coating 20 may more easily be laid down in a uniform fashion. To facilitate this, exit window 2 is made in this example as a separate piece which is attached to main body 4 to close up envelope 1.

With filter coatings 20 of the type described, over 50% of the radiation in the infrared range will typically be reflected, and over 50% of the radiation in the visible range will typically be transmitted.

FIG. 1 shows that filament 14 is elongated, and is mounted to extend along focal axis 16 and to pass through focus F. When a beam 22 of radiation (containing infrared and visible components) from that point on filament 14 which is coincident with focus F is initially directed towards reflector 23 at the base of the lamp, beam 22 is then reflected towards exit window 2 parallel to focal axis 16, because this reflection is a property of the parabolic surface of reflector 23. When beam 22 reaches filter coating 20, a large portion of its visible radiation component will be transmitted through filter coating 20 and exit window 2 and will exit the lamp as beam $22_V$ in a straight line parallel to focal axis 16. Furthermore, a large portion of the infrared radiation component $22_I$ of beam 22 will be reflected back towards focus F by filter coating 20 because such reflection is a property of its parabolic surface. The infrared radiation component $22_I$ will increase the temperature of filament 14 and thereby decrease the amount of energy necessary to raise filament 14 to its desired operating temperature.

In the foregoing example, a beam 22 originating from filament 14 at focus F was first incident upon reflector 23. Alternatively, a beam 24 of radiation from filament 14 originating at focus F may first be incident upon filter coating 20. As before, beam 24 will originally contain both infrared and visible radiation components, and a large portion of the visible component will be transmitted through filter coating 20 as a result of the transmissive properties thereof to leave the lamp at an angle to focal axis 16 as beam $24_V$. The infrared component $24_I$ will be reflected parallel to axis 16 off the parabolic surface of filter coating 20. The infrared component $24_I$ will then reflect off reflector 23 and be directed to filament 14 at focus F. Hence, in both cases, rays emanating from filament 14 at focus F will have their infrared components returned back to filament 14 after two bounces, whether such rays are originally directed toward filter coating 20 or toward reflector 23.

In the foregoing discussion, no mention was made of the relative dimensions of filter coating 20 and reflector 23, since the reflections described were intrinsic properties of parabolic surfaces, as such. Two preferred embodiments of the invention can be considered; a first embodiment in which filter coating 20 and reflector 23 are symmetrical, and a second embodiment in which they are asymmetric.

Figure 2:
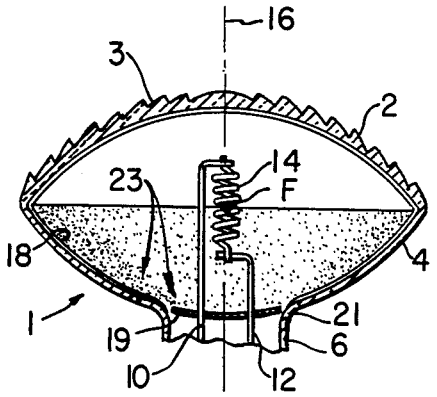
FIG. 2 shows a cross-sectional schematic view of a first embodiment of the invention which uses symmetrical parabolic reflecting surfaces.

Where, as in FIG. 2, the surfaces of filter coating 20 and reflector 23 are symmetrical, filament 14 may be centered on focus F along focal axis 16. Since light rays leaving the lamp through exit window 2 will be parallel to focal axis 16 only if they first reflect off reflector 23, only rays from that part of filament 14 which is located between focus F and reflector 23 will be parallel to axis 16. It is the rays of light which are parallel to focal axis 16 which provide directed (and thus more intense) illumination. Therefore, in a lamp which is designed to spotlight a relatively small area with intense illumination, it is desirable to increase the proportion of rays which are parallel to focal axis 16. Satisfactory collimation (parallelism between the rays in the beam of light leaving the lamp and focal axis 16) can be achieved if the length of filament 14 is selected in accordance with the focal lengths of filter coating 20 and reflector 23.

Such selection begins with a computation of the total parabolic length of the lamp. This total parabolic length is defined as the sum of the focal lengths of the surface of filter coating 20 and the surface of reflector 23. Here, the total parabolic length is equal to twice the focal length of either of these surfaces, since they are symmetrical. When symmetrical surfaces are used and when filament 14 is centered on focus F, satisfactory collimation will result if the length of filament 14 is chosen to be less than 40% (preferably 30%) of the total parabolic length of the lamp. Should the degree of collimation thus achieved still be insufficient, the outer surface of exit window 2 can be molded into the shape of a collimating lens, for example a Fresnel lens 3 such as is shown in FIG. 2. Fresnel lens 3 can alternatively be a cover secured to exit window 2, as by molding or glueing.

It is possible to produce a sufficiently collimated beam of light from the lamp if the surfaces of filter coating 20 and reflector 23 are asymmetric. This is illustrated in the embodiment of the invention shown in FIG. 3.

Figure 3:
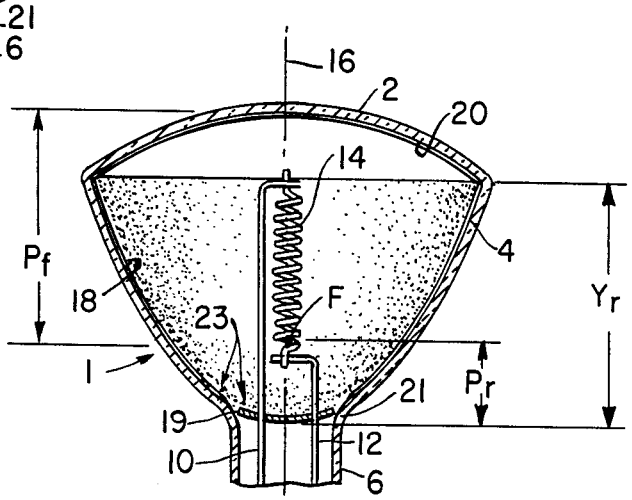
FIG. 3 shows a second embodiment of the invention which uses asymmetric parabolic reflecting surfaces.

In FIG. 3, the parabolic surfaces of filter coating 20 and reflector 23 remain confocal and orthogonal to the focal axis, but have different focal lengths. The focal length $P_f$ of the surface of filter coating 20 is equal to the distance between the center of filter coating 20 and focus F, measured along focal axis 16. Similarly, the focal length $P_r$ of the surface of reflector 23 is equal to the distance between its center (at the center of plate 19) and focus F, measured along focal axis 16. FIG. 3 shows that $P_f$ is greater than $P_r$. In this example, $P_f$ may be between about 1.5 and 5 times $P_r$.

In the embodiment of FIG. 3, it can be shown that satisfactory collimation will result if the length of filament 14 is chosen to be 85% of the difference between the depth $Y_r$ of the reflector 23 (measured along focal axis 16 and shown in FIG. 3) and $P_r$. As in FIG. 1, the outer surface of exit window 2 can have a collimating lens such as a Fresnel lens (not shown) in the event that collimation is to be further improved. The Fresnel lens can be integral with exit window 2 or attached thereto, as before.

As in the embodiment of FIG. 2, there is an alternative way in which collimation of light produced by the embodiment of FIG. 3 can be increased. This is to increase the surface area of the rear reflector to such an extent that, for practical purposes, filament 14 can be regarded as a point source located at focus F, while keeping $P_r$ at a suitable fraction of $P_f$. However, in the embodiments of FIGS. 2 and 3, the possible degree of improvement in performance is limited because exit window 2 always subtends a solid angle having a vertex at focus F. As mentioned above, light rays from filament 14 which impinge directly upon filter coating 20 will leave the lamp at an angle with respect to focal axis 16. Therefore, it is impossible to collimate all of the light produced by filament 14.

What is claimed is:

1. An energy-efficient incandescent lamp, comprising:

a hollow envelope having an exit window with an infrared reflecting and visible transmitting filter coating thereon, the exit window on which said filter coating is located having a parabolic first surface which faces the interior of the envelope with a first focal length, a focus, and a focal axis, reflector means reflective to both infrared and visible energy having a parabolic second surface, a second focal length, a focus and a focal axis, said focus of said second surface being located inside the envelope, the focal axis of each of said first and second surfaces being coaxial and the focus of each said parabolic surface being confocal; and a filament located inside the envelope for producing energy both in the infrared and visible ranges, the filament being at least in part on said confocal foci of said surface, the infrared energy produced by said filament being reflected at least in part by said first and second surfaces back to said filament to raise its operating temperature and the visible range energy being reflected from said second surface for exiting through said exit window in a substantially collimated beam.

2. The lamp of claim 1, wherein the filament is elongated and lies along the focal axis.

3. The lamp of claim 2, wherein the first and second parabolic surfaces are symmetrical.

4. The lamp of claim 2, wherein the lamp has a total parabolic length equal to the sum of the first and second focal lengths and the filament has a filament length less than or equal to about 40% of the total parabolic length.

5. The lamp of claim 4, wherein the filament length is less than or equal to about 30% of the total parabolic length.

6. The lamp of claim 2, wherein the first and second parabolic surfaces are asymmetric.

7. The lamp of claim 6, wherein the focal length of the first parabolic surface is less than the focal length of the second parabolic surface.

8. The lamp of claim 7, wherein the focal length of the second parabolic surface is in a range between about 1.5 and about 5 times the focal length of the first parabolic surface.

9. The lamp of claim 8, wherein one end of the filament is located substantially at the confocal foci of said surfaces.

10. The lamp of claim 9, wherein another end of the filament is closer to the first surface than said one end.

11. The lamp of claim 10, wherein the filament has a filament length chosen such that $$L = 85\% \ (Y_r - P_r)$$

wherein

L = filament length;

$Y_r$ = depth of the second surface, measured along the focal axis; and $P_r$ = the second focal length.

12. The lamp of claim 1, wherein the reflector means of said second surface comprises a layer of highly reflective metal on said envelope.

13. The lamp of claim 12, wherein the metal is silver.

14. The lamp of claim 11, wherein the layer is laid down on an inner surface of said second surface of said envelope.

15. The lamp of claim 1, wherein the filter coating is located on an inner surface of said exit window of said envelope.

16. The lamp of claim 15, wherein the filter coating is a multilayer coating.

17. The lamp of claim 16, wherein the filter coating comprises three layers.

18. The lamp of claim 17, wherein the three layers comprise two outer layers of titanium dioxide and an inner layer of silver.

19. The lamp of claim 1, further comprising a collimating lens mounted on the exit window for collimating the visible light exiting from said window.

20. The lamp of claim 19, wherein the lens is integral with the exit window.

21. The lamp of claim 19, wherein the lens is a Fresnel lens.

* * * * *